United States Patent [19]

McNeely

[11] Patent Number: 4,688,510

[45] Date of Patent: Aug. 25, 1987

[54] PLACE MARKER

[76] Inventor: Fay C. McNeely, Rte. 2, Spencer, Wis. 54479

[21] Appl. No.: 896,232

[22] Filed: Aug. 14, 1986

[51] Int. Cl.[4] ..... B42D 9/00; A44B 21/00

[52] U.S. Cl. ..... 116/237; 33/2 H; 33/485

[58] Field of Search ..... 116/234, 236, 237; 33/2 H, 161, 485

[56] References Cited

U.S. PATENT DOCUMENTS

| | | | |
|---|---|---|---|
| 194,305 | 8/1877 | Marshall | 116/237 |
| 283,576 | 8/1883 | Crabtree | 116/236 |
| 1,355,025 | 10/1920 | Alpert et al. | 116/236 |
| 1,979,789 | 11/1934 | Barrett | 33/2 H |
| 2,388,736 | 11/1945 | Germain | 116/236 |
| 2,592,362 | 4/1952 | Weeks | 33/2 H |
| 2,699,748 | 1/1955 | Crawford | 116/236 |
| 3,656,213 | 4/1972 | McNeely | 33/2 H |

FOREIGN PATENT DOCUMENTS

| | | | |
|---|---|---|---|
| 670737 | 12/1929 | France | 33/161 |
| 5410 | 7/1892 | Switzerland | 33/161 |

*Primary Examiner*—Richard R. Stearns

*Attorney, Agent, or Firm*—Fuller, Puerner & Hohenfeldt

[57] ABSTRACT

A marker device that clips onto a page, for example, has a spring between proximal ends of a pair of similar congruent leaves so as to spread the proximal ends away from each other and press corresponding opposite distal ends toward each other. One leaf has graduations on it constituting part of a scale or ruler. A third flat straight leaf is connected to one of the pair of spring-biased leaves in such manner that the third leaf can slide and extend or contract relative to the one leaf. The third leaf has graduations that form a continuous measuring scale in conjunction with the graduations on the one leaf when the third leaf is fully extended.

2 Claims, 5 Drawing Figures

PLACE MARKER

BACKGROUND OF THE INVENTION

The articles of manufacture disclosed herein is an improvement over a hemming clip described in U.S. Pat. No. 3,656,213 which is incorporated herein by reference. The new device is called a "Place Marker" but it has a variety of uses only limited by the imagination of the user. It can be used, for example, to mark one's place in a recipe book as one goes through the items in a recipe sequentially. It can also be used to temporarily mark the place of a reader in any printed material or it may be used on a knitting or crocheting pattern to assist in keeping track of row counts and distances. It also serves as a ruler.

SUMMARY OF THE INVENTION

The new place marker is based on the spring-biased hemming clip disclosed in the above cited patent. The clip is comprised of two leaves, comparable to a pair of congruent generally flat fingers. There is a U-shaped flat spring fastened between corresponding proximal ends of the leaves such that the proximal ends are biased away from each other and the opposite distal ends are pressed toward each other. Pressing on the proximal ends overcomes the spring bias and separates the distal ends. At least one of the leaves has its outer flat surface graduated in inches and parts of an inch to provide a scale having its zero line coincident with the bight of the U-shaped flat spring between the leaves. A third flat extension leaf is fastened to one of the spring-biased leaves in such manner that the extension leaf can be slid along the length of one of the spring-biased leaves whereby the extension leaf may be extended or retracted relative to the spring-biased leaves. The extension leaf has a scale inscribed on it which is a continuation of the scale that is inscribed on either or both of the congruent spring-biased leaves. When the extension leaf is slid out or fully extended to a limit relative to the spring-biased leaves, the scale is continuous from, for example, zero to nine inches in one-quarter inch increments.

The device has the advantage of being contractible to minimize its size and make it convenient for storing or carrying in the user's pocket. The device can be temporarily secured on a page or a pattern sheet, for example, by pressing the proximal ends of the spring-biased leaves toward each other in opposition to the spring to thereby spread open the distal ends for slipping over the edge of a sheet in a book.

A more detailed description of an embodiment of the new self-gripping place marker will now be described in reference to the drawing.

DESCRIPTION OF A PREFERRED EMBODIMENT

Figure 1:
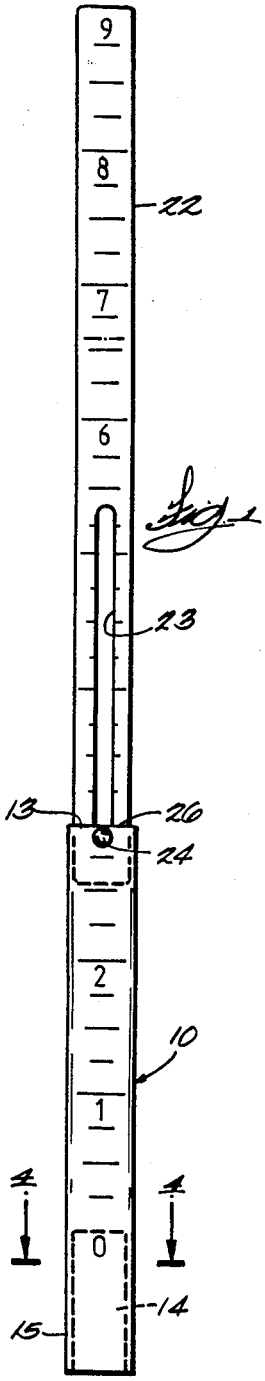
FIG. 1 is a plan view of the new marker clip showing the extension leaf extended.
Figure 2:
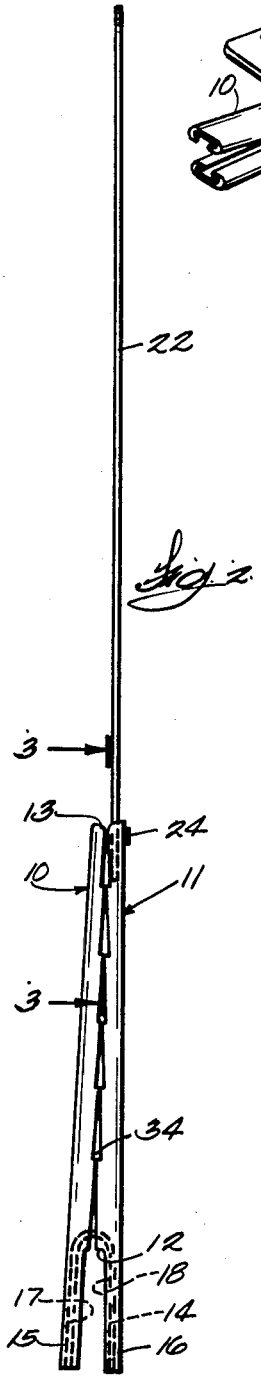
FIG. 2 is a side elevation view of the marker shown in FIG. 1.
Figure 4:
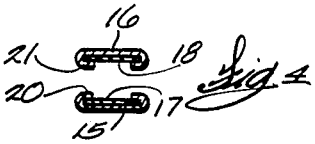
FIG. 4 is a section taken on the line corresponding with 4—4 in FIG. 1.
Figure 3:
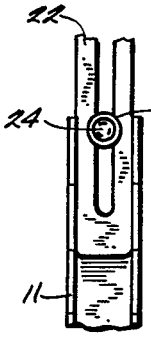
FIG. 3 is a plan view of a portion of the marker taken on the line corresponding with 3—3 in FIG. 2 and showing a fragment of one of the spring-biased leaves and a fragment of the slidable extension leaf and also showing how the extension leaf is mounted to one of the spring-biased leaves for sliding.

Referring to FIGS. 1 and 2, the marker comprises a pair of similar leaves 10 and 11 which are congruent with each other. The leaves are comprised of thin metal in the depicted embodiment and are channel shaped in cross-section over that part of their length which extends from the place marked 12 near their proximal ends to their distal ends 13. There is a flat U-shaped spring 14 interposed between the proximal ends 15 and 16 of the leaves 10 and 11. As is most evident in FIG. 2, the flat spring 14 has two straight flat opposite leg portions 17 and 18 and a curved or bight portion 19. As shown in FIG. 4, the opposite edges 20 and 21, for example, are rolled over to capture the straight portions 17 and 18 of the spring. The spring is preloaded so that when the leaves are assembled to form a clip, the proximal ends 15 and 16 of the leaves are urged away from each other and the distal ends 13 are spring pressed toward each other.

As shown in FIG. 1, a flat extension leaf 22 is fastened to one of the pair of spring-biased leaves 10 or 11 for sliding in the channel formed by the inside surfaces and sides of the leaves 10 and 11. Flat extension leaf 22 is provided with a longitudinally extending slot 23. A fastener such as rivet 24 extends through the slot and through a hole in one of the spring-biased leaves 11 and a washer 25 is placed on the rivet before it is peened to hold the extension leaf 22 to the spring-biased leaf. Rivet 24 is peened sufficiently to keep the extendible and contractible leaf 22 pressed into the channel formed by the sides and inner surface of spring-biased leaf 11 permit sliding longitudinally with some frictional drag relative to spring-biased leaf 11.

As can be seen in FIG. 1, the tip or distal end 13 of both spring-biased leaves 10 and 11 terminate coincident with the three inch mark in this embodiment on the scale inscribed on leaf 10. In effect, the first graduation mark 26 on the scale of extendible leaf 22 also coincides with the three inch mark so that when the leaf 22 is fully extended and stopped by the end of slot 23 abutting rivet 24, the scale becomes uniform and continuous from zero to nine inches in this particular design. Of course, some models may have an extendible leaf 22 that is longer or shorter than the one illustrated. In the FIG. 1 embodiment, when leaf 22 is slid to its inner limit between spring-biased leave 11 and 12, the tip of leaf 22 is in the position indicated by phantom line 27.

Figure 5:
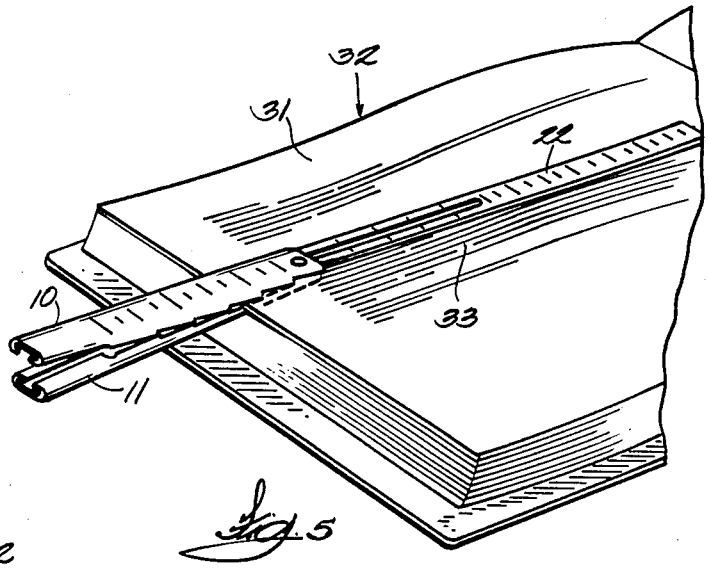
FIG. 5 shows how the new marker may be clamped to several pages of a book, for example, and how it may be placed on the top page to serve as a cursor for keeping track of one's location in a list or other printed material on the top page.

FIG. 5 illustrates one of many possible uses of the place marker. Here the place marker has been clipped onto the top page 31 or a group of underlying pages of a book which is generally designated by the numeral 32. By way of example, there are printed lines 33 on the page and the clip comprised of leaves 10 and 11 is pressed by the flat spring into gripping relation with the page. This will secure the device in any desired position such as where the top edge of slidable leaf 22 will lie just under a line of printed material. Now if the user's attention is diverted for a while from the text on the page, the place of interest will not be lost since the device will act as a cursor that identifies the place at which the user was reading before his or her attention was distracted.

The fact that the clip assembly is provided with an extension leaf makes it adaptable for adjustment to the width of the most common sizes of books and notebooks.

It should be noted that the side walls of the spring-biased channel shaped leaves 10 and 11 are scalloped or provided with shallow saw teeth 34 to enhance a gripping effect between the leaves and any object to which it is clipped.

Although a specific example of the new clip-on place marker has been described in detail, such description is to be considered illustrative rather than limited, for the marker may be made with various dimensions and with some modifications in configuration and is to be limited only by interpretation of the claims which follow.

I claim as my invention:

1. A clip-on place marker comprising:

first and second elongated leaves juxtaposed to each other and having proximal end portions and distal ends, a generally U-shaped spring comprised of a bight and portions extending from opposite sides of the bight, said spring being arranged between corresponding proximal end portions of said leaves, said portions of said spring being fastened, respectively, to said proximal end portions of said leaves, said spring being prestressed such that it biases said proximal end portions apart from each other and said distal ends toward each other, at least one of said first and second leaves having graduations inscribed thereon constituting part of a measuring scale beginning with zero in the proximal end portion of one of said leaves and terminating with a predetermined value at said distal end, said zero mark on said one of the leaves being coincident with said bight.

a third leaf and means for mounting said third leaf to one of said first and second leaves for sliding lengthwise of said leaves between said leaves so as to be extendible and contractible relative to said leaves between inner and outer limits, said third leaf also having a portion of a measuring scale thereon such that when said third leaf is extended to its outermost limit the measuring scale on said one of the leaves and said third leaf become continuous.

2. The marker according to claim 1 wherein said third leaf has one end portion that slides between said first and second leaves and a slot through said end portion extending lengthwise thereof, and said mounting means comprises a fastener extending through the distal end of one of said first and second leaves and through said slot for retaining said third leaf slidably on said one leaf, one end of said slot striking said fastener to set the outward travel limit of said third leaf.

* * * * *